US008845439B2

(12) United States Patent
Kroon et al.

(10) Patent No.: US 8,845,439 B2
(45) Date of Patent: Sep. 30, 2014

(54) ENTERTAINMENT SYSTEM WITH SWING AND ROTATABLE SEATS

(75) Inventors: Albert Louisito Phillipus Kroon, Neede (NL); Jan Hendrik Wessel Hartemink, Lichtenvoorde (NL)

(73) Assignee: Cobra Beheer B.V., Neede (NL)

( * ) Notice: Subject to any disclaimer, the term of this patent is extended or adjusted under 35 U.S.C. 154(b) by 71 days.

(21) Appl. No.: 13/459,519

(22) Filed: Apr. 30, 2012

(65) Prior Publication Data

US 2012/0277009 A1 Nov. 1, 2012

(30) Foreign Application Priority Data

Apr. 28, 2011 (NL) ..... 2006677

(51) Int. Cl.
*A63G 1/26* (2006.01)
*A63G 9/08* (2006.01)
*A63G 1/10* (2006.01)

(52) U.S. Cl.
CPC .. *A63G 1/10* (2013.01); *A63G 1/26* (2013.01); *A63G 9/08* (2013.01)
USPC ..... 472/47

(58) Field of Classification Search
USPC ..... 472/47
See application file for complete search history.

(56) References Cited

U.S. PATENT DOCUMENTS

| | | | | |
|---|---|---|---|---|
| 3,707,282 | A * | 12/1972 | Robinson | 472/1 |
| 4,643,416 | A * | 2/1987 | van der Veen | 472/45 |
| 5,395,290 | A * | 3/1995 | Knijpstra | 472/31 |
| 6,872,144 | B2 * | 3/2005 | Kroon et al. | 472/45 |
| 2006/0035715 | A1 | 2/2006 | Threlkel | |

FOREIGN PATENT DOCUMENTS

| | | |
|---|---|---|
| CA | 891655 | 1/1972 |
| GB | 2337944 | 12/1999 |
| NL | 1008039 | 7/1999 |
| NL | 1019209 | 4/2003 |

OTHER PUBLICATIONS

Dutch search report dated Dec. 15, 2011 in corresponding NL 2006677.

* cited by examiner

*Primary Examiner* — Michael Dennis
(74) *Attorney, Agent, or Firm* — Young & Thompson

(57) ABSTRACT

An amusement device includes at least one swinging arm, one end of which is suspended so as to be rotatable about a swinging axis and one free end of which is displaceable along at least a part of a circular path about the swinging axis. A carrier is suspended from the free end of the swinging arm and is rotatable about an axis of rotation transversely to the swinging axis. Furthermore, there is at least one support device for at least one person which is suspended from the carrier at a distance from the axis of rotation thereof. The support device is rotatable with respect to the carrier.

19 Claims, 2 Drawing Sheets

ENTERTAINMENT SYSTEM WITH SWING AND ROTATABLE SEATS

FIELD OF THE INVENTION

The invention relates to an amusement device, comprising at least one swinging arm, one end of which is suspended so as to be rotatable about a swinging axis and one free end of which is displaceable along at least a part of a circular path about the swinging axis, a carrier which is suspended from the free end of the swinging arm and which is rotatable about an axis of rotation transversely to the swinging axis, and at least one support device for at least one person which is suspended from the carrier at a distance from the axis of rotation thereof.

BACKGROUND OF THE INVENTION

Such an amusement device is known from NL-C-1008039. This known amusement device has a swinging arm in the shape of a bell. The bottom portion of the bell is rotatable with respect to the upper part thereof, about an axis of rotation transversely to the swinging axis. Seats may be fixedly suspended from the bottom part of the bell. Furthermore, a variant is known in which a separate frame is suspended in the bottom part of the bell. This frame may also be configured to be rotatable, more particularly about an axis of rotation which coincides with that of the bottom part of the bell. Seats may also be fixedly suspended from said frame.

During the swinging movement, the bottom part of the bell may be rotated about the axis of rotation. As a result thereof, the seats move according to a circle which coincides with the bottom edge of the bell. In this variant, the seats which are suspended from the frame also move along such a circle. In this case, the seats always have a fixed position with respect to the bottom part of the bell or with respect to the frame. The aim is to give the occupants a sensation as a result of this combination of rotations.

US2006/035715 A1 discloses an amusement device with a support device which is connected to an arm with many degrees of freedom of movement.

NL1019209C2 discloses a swingable bell body comprising pods which co-rotate with the bottom bell part so as to carry out both a rotation about the axis of the bell and an oscillating movement.

SUMMARY OF THE INVENTION

It is an object of the invention to provide an improved amusement device of this type, wherein the sensation can still be intensified. Said object is achieved by the fact that the support device rotatable is with respect to the carrier. Due to the fact that the movements to which the occupants are subjected to now consist of three different rotations, namely a rotation about the swinging axis, a rotation about the axis of rotation of the carrier and a rotation about the axis of rotation of the support device, a stronger sensation is produced.

The rotation which the support device carries out with respect to the carrier may be directed in different directions. However, the variant in which the support device is rotatable about an axis of rotation which runs parallel to the axis of rotation of the carrier is preferred. A variant in which the support device is rotatable about an axis of rotation which is directed transversely with respect to the axis of rotation of the carrier, and which preferably crosses the axis of rotation of the carrier is conceivable. In particular, the axis of rotation of the support device may be directed perpendicularly to the axis of rotation of the carrier. Both variants can also be combined.

The support device may be configured in different ways and in each case has at least one seat. It is of course also possible to provide two or more seats next to each other and to attach the combination by means of a symmetrically placed suspension to a pivoting suspension. In addition, several support devices may be provided evenly distributed around the circumference of the carrier.

Preferably, the carrier is rotationally symmetrical with respect to the axis of rotation thereof. In particular, the carrier may comprise bearing arms which are radially directed at identical angles with respect to each other. On the outer end of these arms, a support device may be in each case rotatably suspended. Preferably, the carrier can be moved with respect to the swinging arm or swinging arms only and solely about the associated axis of rotation. In that case, other degrees of freedom between the carrier and the swinging arm or swinging arms do therefore not occur.

In particular, the swing has two A-shaped or inverted V-shaped frames which are arranged next to each other in such a way that the swinging axis extends between the tops of the frames. This swing is stable and makes it possible to fold up the frames, thus providing a compact swing for transportation purposes. The swinging arm can also be configured in different ways. In particular, two swinging arms may be provided, one of which is suspended from the one frame and the other is suspended from the other frame, which swinging arms are directed towards each other at an angle from said tops and are attached to each other at their free end. Alternatively, the swinging arms may be connected to each other via a housing from which the carrier is suspended.

As described above, the amusement device may be configured as a pure swing in order to carry out to and fro movements about the swinging axis. However, it is also possible to configure the amusement device as having a swinging arm which can perform complete rotations about the swinging axis. In the latter case, an embodiment is preferred in which at least one balance arm is provided which is attached to at least one swinging arm, and a mass is provided on the free end of the balance arm, which balance arm is situated on the side of the axis of rotation opposite the side thereof where a swinging arm is situated.

Furthermore, at least one second swinging arm may be provided in such a manner that a first and second swinging arm are symmetrically arranged with respect to the swinging axis. In this case, a second carrier is suspended from the free end of the second swinging arm and is rotatable about an axis of rotation transversely to the swinging axis, and at least one support device for at least one person is suspended from the second carrier at a distance to the axis of rotation thereof This support device and the support device of the first carrier are rotatable about an axis of rotation perpendicular to the axis of rotation of the second carrier, in such a manner that the occupants can carry out a complete rotation without ending up upside down.

BRIEF DESCRIPTION OF THE DRAWINGS

The invention will now be described further by means of an exemplary embodiment illustrated in the figures, in which.

DETAILED DESCRIPTION OF THE INVENTION

Figure 1:
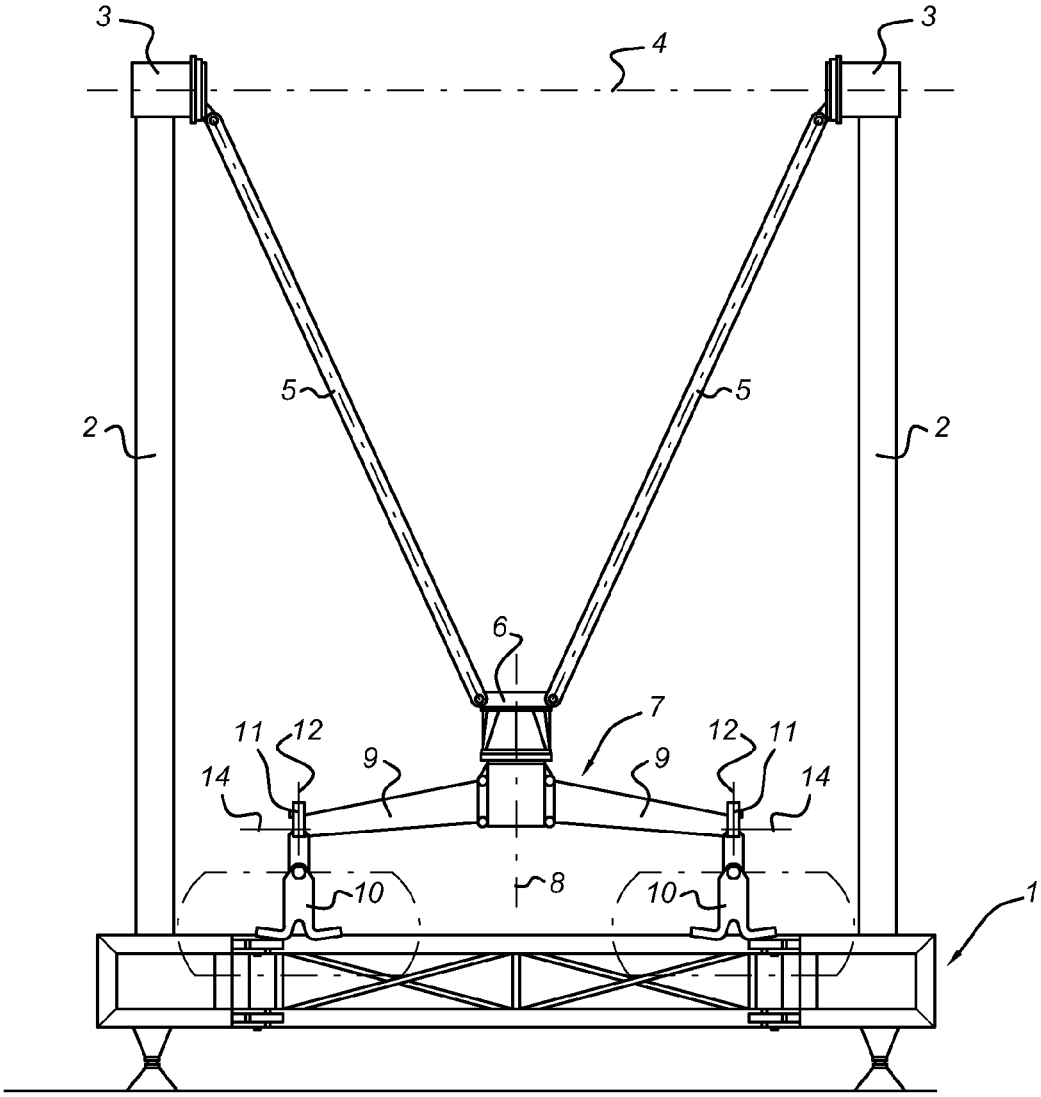
FIG. 1 shows a front view of the amusement device, in the rest position.

The amusement device illustrated in the figures has a base 1 which may, for example, be composed of a number of mobile platforms, such as several lorry chassis. Two A-shaped or inverted V-shaped frames 2 are arranged parallel and at a distance to one another on this base 1. In the top of each frame, a pivoting suspension 3 is in each case fitted, which determines the common swinging axis 4. A swinging arm 5 is attached to each pivoting suspension 3. The swinging arms 5 run from the respective pivoting suspensions 3 towards each other at an angle. It is possible to use a supporting beam (not shown), which supporting beam extends along the swinging axis and is attached to the two frames 2 in order to keep these a distance apart. It is conceivable for the supporting beam to be connected to the two frames via the two pivoting suspensions 3.

At their bottom end, the swinging arms 5 are connected to each other by means of the housing 6. Said housing 6 supports a carrier 7 which is rotatable about the axis of rotation 8. In the illustrated exemplary embodiment, said axis of rotation 8 of the carrier 7 is directed at right angles to the swinging axis 7, and preferably crosses the latter. The carrier 7 has a number of arms 9, for example six, which extend radially outwards with respect to the axis of rotation 8 of the carrier 7.

On the radially outer end of each arm 9, a support device 10 is suspended. Said support device may contain one or more seats. The support device 10 is connected to said end of the arm 9 by means of a first pivoting suspension 11. Said pivoting suspension 11 has an axis of rotation 12 which is substantially parallel to the axis of rotation 8 of the carrier.

Furthermore, the support device 10 is suspended from the arm 9 by means of a second pivoting suspension 13, the axis 14 of which runs in the longitudinal direction of the arm 9. Said axis of rotation 14 is directed transversely, in particular perpendicularly, to the axis of rotation 8 of the carrier 6.

Figure 2:
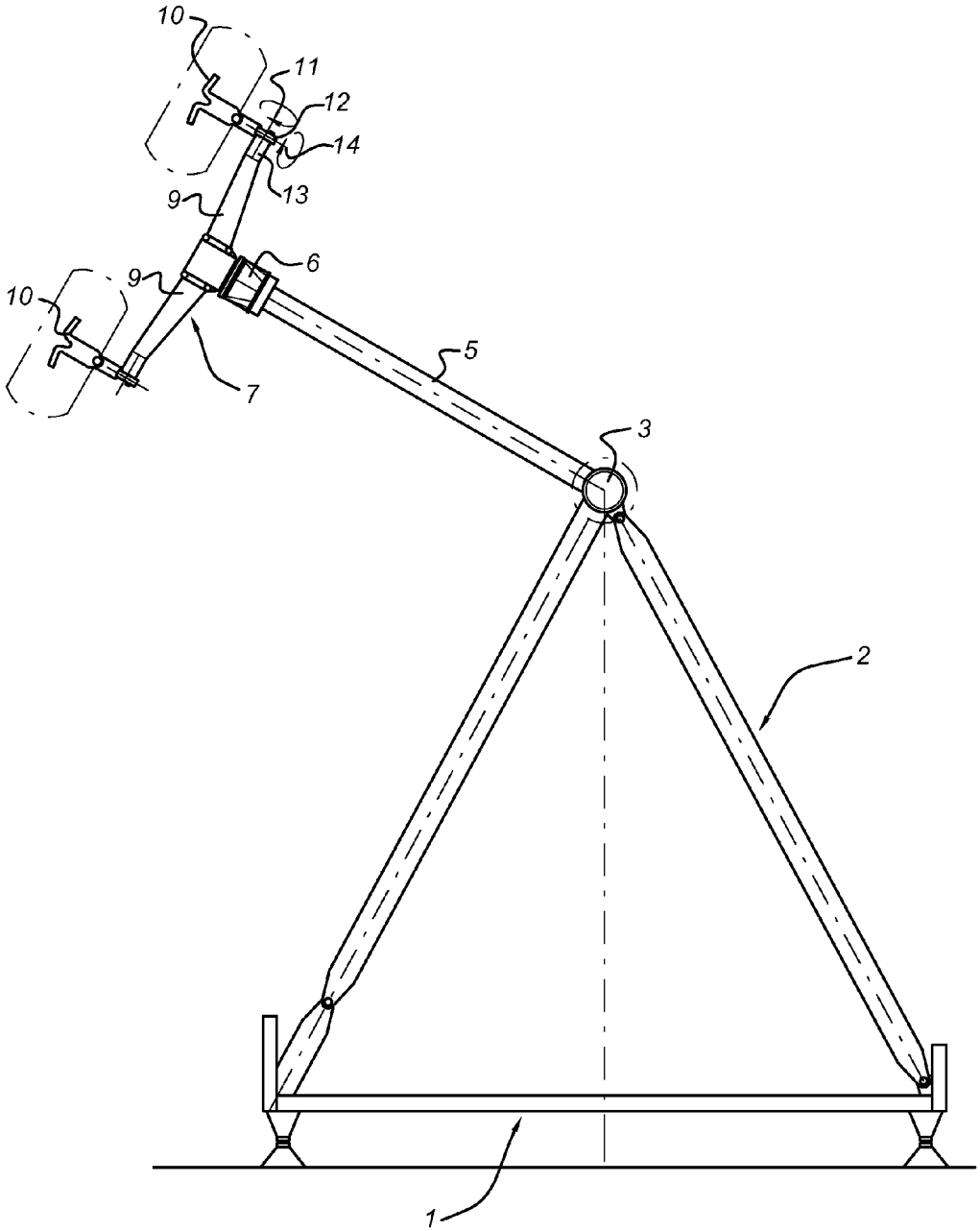
FIG. 2 shows a side view of the amusement device, in the swung out position.

By rotating the swinging arms 5 about the swinging arm 4 in the direction of the arrow, as shown in FIG. 2, the support devices 10 are swung upwards. The carrier 7 can simultaneously carry out a rotation about the axis of rotation 8 thereof, also indicated by an arrow in FIG. 2. Furthermore, the support device 10 can carry out a rotation about the axis of rotation 12, indicated by the respective arrow. If desired, the support device 10 can also carry out a rotation about the axis of rotation 14, indicated by the respective arrow, of the second pivoting suspension 13.

LIST OF REFERENCE NUMERALS

1. Base
2. A-shaped or inverted V-shaped frame
3. Pivoting suspension in top of frame
4. Swinging axis
5. Swinging arm
6. Housing
7. Carrier
8. Axis of rotation of carrier
9. Carrier arm
10. Support device
11. Pivoting suspension of support device
12. Pivoting suspension axis 11
13. Pivoting suspension of support device
14. Pivoting suspension axis 13

The invention claimed is:

1. An amusement device, comprising: two swinging arms, with each of said arms having one end which is suspended so as to be rotatable about a swinging axis, and one free end which is displaceable along at least a part of a circular path about the swinging axis, wherein the arms are directed toward each other at an angle and attached to a housing at their free ends, a carrier which is suspended from the housing at the free ends of the swinging arms and which is rotatable about an axis ~ of rotation transversely to the swinging axis, and at least one support device for at least one person which is suspended from the carrier at a distance from the axis of rotation thereof, wherein the support device is rotatable with respect to the carrier about an axis of rotation which runs parallel to the axis of rotation.

2. The amusement device according to claim 1, wherein the support device is rotatable about an axis of rotation which runs parallel to the axis of rotation of the carrier.

3. The amusement device according to claim 1, wherein the support device is rotatable about an axis of rotation which is directed transversely with respect to the axis of rotation of the carrier, preferably crosses the axis of rotation of the carrier.

4. The amusement device according to claim 3, wherein the axis of rotation of the support device is directed perpendicularly to the axis of rotation of the carrier.

5. The amusement device according to claim 1, wherein the support device comprises at least one seat.

6. The amusement device according to claim 1, wherein several support devices are provided evenly distributed around the circumference of the carrier.

7. The amusement device according to claim 1, wherein the carrier is rotationally symmetrical with respect to the axis of rotation thereof.

8. The amusement device according to claim 6, wherein the carrier comprises bearing arms which are radially directed at identical angles with respect to each other, on the outer end of which bearing arms a support device is in each case rotatably suspended.

9. The amusement device according to claim 1, wherein two A-shaped or inverted V-shaped frames are provided which are arranged next to each other, and the swinging axis extends between the tops of the frames.

10. The amusement device according to claim 9, comprising two swinging arms, a first swinging arm being suspended from one of the two frames and a second swinging arm being suspended from the other of the two frames, wherein said two swinging arms are directed towards each other at an angle from said tops and are attached to each other at their free end.

11. The amusement device according to claim 9,wherein a first swinging arm is suspended from one of the two frames and a second swinging arm is suspended from the other of the two frames.

12. The amusement device according to claim 1, wherein the carrier can be moved with respect to the at least one swinging arm only and solely about the associated axis of rotation.

13. The amusement device according to claim 1, further comprising:

at least one balance arm which is attached to at least one swinging arm, and a mass provided on the free end of the balance arm, wherein the balance arm is situated on a side of the axis of rotation that is opposite the side thereof where said swinging arm is situated.

14. The amusement device according to claim 1, comprising:

at least one second swinging arm, the first swinging arm and the second swinging arm being symmetrically arranged with respect to the swinging axis, a second carrier suspended from the free end of the second swinging arm and rotatable about an axis of rotation transversely to the swinging axis, and at least one support device for at least one person suspended from the second carrier at a distance from the axis of rotation thereof, wherein the support device on the second carrier and the support device on the first carrier are rotatable about an axis of rotation which is perpendicular to the axis of rotation of the associated carrier.

15. The amusement device according to claim 2, wherein the support device is rotatable about an axis of rotation which is directed transversely with respect to the axis of rotation of the carrier, preferably crosses the axis of rotation of the carrier.

16. The amusement device according to claim 15, wherein the axis of rotation of the support device is directed perpendicularly to the axis of rotation of the carrier.

17. The amusement device according to claim 7, wherein the carrier comprises bearing arms which are radially directed at identical angles with respect to each other, and on the outer end of said bearing arms a support device is in each case rotatably suspended.

18. A swinging amusement device comprising:

first and second frames arranged parallel to each other with a swinging axis extending between tops of the frames;

first and second swinging arms suspended from the first and second frames to be rotatable in unison about the swinging axis and angled towards each other;

a housing connected to the free ends of the first and second swinging arms;

a carrier which is suspended from the housing at the free ends of the swinging arms and which is rotatable about an axis of rotation transversely to the swinging axis; and at least one support device for at least one person which is suspended from the carrier at a distance from the axis of rotation, wherein the support device is rotatable with respect to the carrier about an axis of rotation which runs parallel to the axis of rotation.

19. A swinging amusement device comprising:

first and second frames arranged parallel to each other with a swinging axis extending between tops of the frames;

first and second swinging arms suspended from the first and second frames to be rotatable about the swinging axis and angled towards each other;

a carrier which is suspended from the free ends of the swinging arms and which is rotatable about an axis of rotation transversely to the swinging axis; and at least one support device for at least one person which is suspended from the carrier at a distance from the axis of rotation, wherein the support device is rotatable respect to the carrier about an axis of rotation which runs parallel to the axis of rotation of the carrier and about an axis of rotation which runs transverse to the axis of rotation of the carrier and crosses the axis of rotation of the carrier.

* * * * *